United States Patent [19]

Nerli et al.

[11] Patent Number: 4,698,960

[45] Date of Patent: Oct. 13, 1987

[54] FRICTION OPEN-END SPINNING PROCESS AND APPARATUS

[75] Inventors: Giovanni Nerli, Florence; Solitario Nesti, San Baronto; Francesco Grego, Portogruaro; Roberto Bottos; Francesco Ferro, both of Pordenone, all of Italy

[73] Assignee: 501 Officine Savio S.p.A., Pordenone, Italy

[21] Appl. No.: 896,281

[22] Filed: Aug. 14, 1986

[30] Foreign Application Priority Data

Sep. 11, 1985 [IT] Italy ..... 22112 A/85

[51] Int. Cl.[4] ..... D01H 1/12; D01H 1/135

[52] U.S. Cl. ..... 57/401

[58] Field of Search ..... 57/400, 401, 263, 408

[56] References Cited

U.S. PATENT DOCUMENTS

| | | | |
|---|---|---|---|
| 4,130,983 | 12/1978 | Dammann et al. | 57/401 X |
| 4,202,162 | 5/1980 | Vignon | 57/401 |
| 4,202,163 | 5/1980 | Turk et al. | 57/401 |
| 4,497,168 | 2/1985 | Kamp | 57/408 X |

FOREIGN PATENT DOCUMENTS

| | | | |
|---|---|---|---|
| 1231198 | 5/1971 | United Kingdom | 57/401 |

*Primary Examiner*—Donald Watkins

*Attorney, Agent, or Firm*—Morgan & Finnegan

[57] ABSTRACT

A friction open-end spinning process wherein the fibers of the feeding fiber sliver, once separated into discrete fibers, are sucked by a suction slot on a revolving twister element provided with a perforated surface, to feed the free end of the yarn being formed. The process is characterized in that the fibers are fed in a direction parallel to the free end of the yarn being formed, are kept under an adjustable tension throughout the twisting operation, and are subjected to a progressively increasing twist from the open end of the yarn being formed onwards. The device embodying the above process uses a revolving flat disc provided with perforations arranged according to an annulus as the twister element. This element cooperates with a sucking slot, the edge of which, consituting the yarn formation line, is positioned according to a chord of the disc.

10 Claims, 10 Drawing Figures

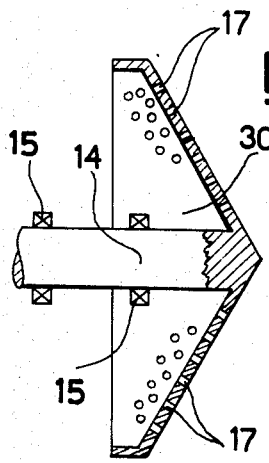
Fig. 5
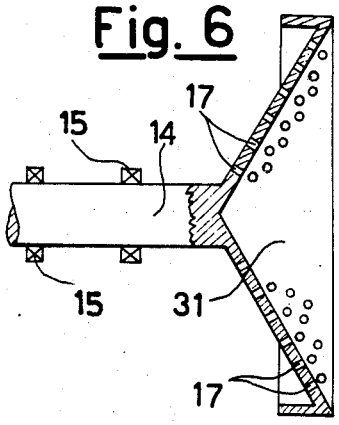
Fig. 6
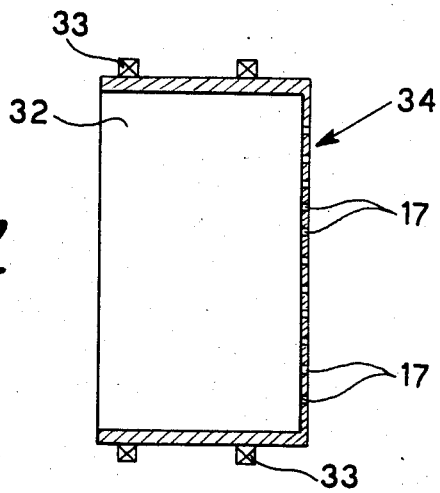
Fig. 7
Fig. 8
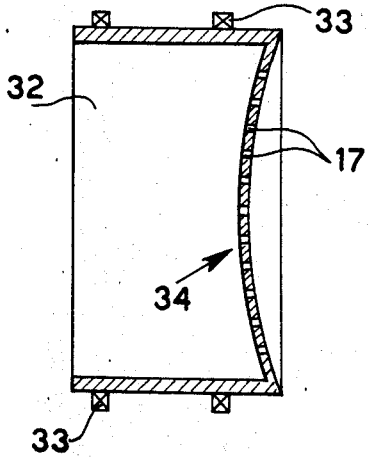
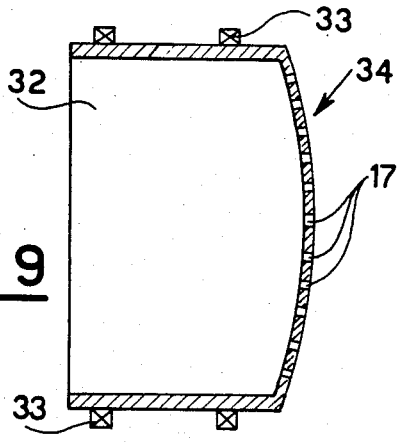
Fig. 9

FRICTION OPEN-END SPINNING PROCESS AND APPARATUS

FIELD OF THE INVENTION

The present invention relates to a spinning process of friction open-end type which allows a yarn having high characteristics of quality and strength to be obtained. The invention also relates to a device allowing the easy, rational and fast performance of the process.

BACKGROUND OF THE INVENTION

Processes and devices for friction-spinning are known in the art. According to these prior art processes, the fibers of the feeding sliver, after being opened by a fiber separation unit, are conveyed onto one or two twister elements, generally revolving or moving cylinders, provided with perforated surfaces and having a suction duct in their interior.

The suction duct defines a slot positioned along a generatrix of the cylinder. The discrete fibers are fed to the free end of the yarn being formed. They are then induced in the suction duct, by means of an air jet, exactly in correspondence with the suction slot, where they condense because of the effect of suction. While being kept adhering to the twister cylinder by the suction, they are conveyed by said cylinder. As soon as they come near the rear edge of the suction slot, and are not influenced any longer by said suction, they roll up around each other and gain twist. Thus, the fibers are condensed and twisted due to the effect of the forces caused by the suction and the motion.

The yarn which is formed thereby is then extracted along the direction of the suction slot by draw rollers and is finally wound and collected on a package.

All of such prior art spinning processes have drawbacks related to the quality of the yarn produced. In fact, the lack of proper tension on the fibers not only limits the possibility of stretching and straightening of the same fiber, but also causes the twist structure to be too spaced, so that the yarn produced is swollen and has poor strength.

Furthermore, in the prior art processes and devices the twisting of the fibers depends substantially on the dragging force applied by the motion of the twister cylinder. This dragging force is constant along a generatrix of the cylinder, and hence along the whole length of the suction slot. This results in the fibers undergoing a twisting rotation inversely proportional to the radius or thickness of fiber agglomerate. Hence, the twisting rotation is practically null at the outlet from the slot and gradually increases towards the open end of the yarn free end. Since the yarn is revolving at a high rpm value, the resulting yarn is strongly centrifuged, which causes a loss of fibers, especially of short fibers, as well as a reduction in yarn evenness. Furthermore, a high twist takes place in the yarn free end.

OBJECTS AND STATEMENT OF THE INVENTION

The purpose of the present invention is to obviate these drawbacks and provide a spinning process of the friction open-end type, which keeps the fibers under an adjustable tension during their twisting.

It is also an object of the present invention to provide a process which permits the twisting to be progressively increasing from the open end of the yarn onwards, the open end thus being no longer subject to a high centrifuging and twisting action.

It is another object of the present invention to provide a process which creates optimum conditions for obtaining a yarn having high characteristics of quality and strength. This is accomplished by allowing the fibers coming from the feeding sliver to be kept under tension and stretched during the twisting thereof. The twisting takes place after the fibers are separated by a fiber separation unit and deposited on a tensioning unit, and allows for a twist gradually increasing from the free end of the yarn onwards up to the yarn coming out from the suction slot to be conferred to said fibers.

The invention also provides a simple and cheap device for the practical accomplishment of the process.

The above outcome is substantially and simply achieved by positioning the suction slot with the yarn formation line along a chord of the twister, instead of along a generatrix of the revolving twister.

The twister is preferably a revolving disc provided with perforations according to an annulus pattern. The suction slot extends from the rim of the disc, and is limited to a portion of perforated annulus of the same disc.

By this arrangement, the dragging speed of the fibers in the individual points at the slot is no longer constant, but varies with the distance of said point from the revolution center and increases linearly from the center to the rim of the disc. Moreover, each dragging speed can be resolved into a component axial to, and perpendicular to the yarn.

These axial components of the speeds, all of which have the same intensity equal to the product of the angular velocity of the twister roller times the distance of the yarn formation line of the suction slot to the disc axis, parallel to the same slot, can all be directed opposite to the yarn draw direction by properly selecting the direction of twister disc revolution. This means that the fibers of yarn being formed are tensioned with a consequent better straightening of the fibers and better closure of the twist and result in a yarn having higher strength and quality being obtained.

From the above it is clear that an easy and fast adjustment of the tensioning of the fibers can be accomplished by simply varying the intensity of the axial components of the speeds, and, with the disc velocity being the same, by varying the distance between the slot and the disc axis. Thus, increasing that distance will increase the tension applied to the fibers.

The perpendicular components of the speeds, which are the generators of the fiber twist, are not constant along the yarn formation line, but vary linearly like the dragging speed. Therefore, the shorter such distances are, the smaller said perpendicular components are. This allows for precise limiting of centrifuging of the open end of yarn and allows the tension to be gradually increasing from the end to the point of complete yarn formation.

Summarizing, the spinning process of the friction open-end type in accordance with this invention consists of opening the fibers of the feed sliver by means of a fiber separation unit, feeding the discrete fibers to the end of the yarn being formed, sucking and adhering the yarn on a twisting element, revolving the yarn using a perforated surface with a suction slot along the yarn formation line of which the yarn end is twisted by the action suction and rotation. The so-formed yarn is then drawn in the direction of the suction slot by means of drawing rollers, and finally wound and collected on a package.

The drawn yarn, according to the present invention, is characterized in that the discrete fibers are fed in a parallel arrangement to the end of the yarn being formed, are kept under an adjustable tension throughout the twisting operation and are subject to a progressively increasing twisting action from the open end of the yarn being formed onward.

According to a further characteristic of the present invention, a device for the spinning of friction open-end type according to the above process comprises: a fiber separating unit to review the feed fiber sliver; a revolving twister element having a perforated surface and cooperating with a suction slot; a suction duct to feed said suction slot; and means for winding up and collecting the formed yarn on a package.

The device is characterized in that the revolving twister element is a revolving flat disc provided with perforations arranged according to an annulus with the suction slot adjustably positioned along a chord of the twister disc, extending from the rim of the disc up to the nearby of the revolution center. The edge of the suction slot thus constituting the yarn formation line.

A further characteristic of the present invention is that the edge of the said suction slot, constituting the yarn formation line, can be adjusted relative to the axis of the twister disc, which is parallel to the slot.

The invention is now discussed with reference to the attached drawings which illustrate one preferred embodiment of the present invention. Technical and structural variations can be made within the scope of the present invention.

For example, the revolving twister element, instead of being a flat disc, can be a hollow conical disc oriented towards the fiber separation unit or to the opposite direction, or it can have the shape of a small cylinder mounted on outer supporting bearings, wherein the perforated surface is provided in the flat basis. In this latter case, the central revolution axle is eliminated, so that perforations can be provided on its whole surface, and not only on an annulus area. thereby it becomes possible t increase the length of the suction slot to come up to the center of the cylinder. This permits the perpendicular component of the speed acting on the yarn end to be zero thus reducing, as desired, the twisting effect on the open end of the yarn being formed. On the other hand, the perforated base of the small cylinder, besides being flat, can also be either concave or convex.

The suction slot, instead of being of rectangular shape, can also have a curved shape, which allows for a variable axial tension to be placed on the fibers.

Also, different patterns of perforation may be provided on the surface of the twister element, i.e., with a hole-to-solid percentage variable along the yarn formation line, or different surface treatments or finishings (roughness) allowing a variable friction coefficient between yarn and twister to be attained. Other elements can also be provided which act on the yarn to achieve such values of axial tension and fiber twisting as to ensure that the resulting yarn is endowed with optimum quality characteristics.

BRIEF DESCRIPTION OF THE DRAWINGS

FIGS. 5 through 9 are lateral sectional views of variants of the twister elements according to the invention.

DETAILED DESCRIPTION OF PREFERRED EMBODIMENTS

Figure 1:
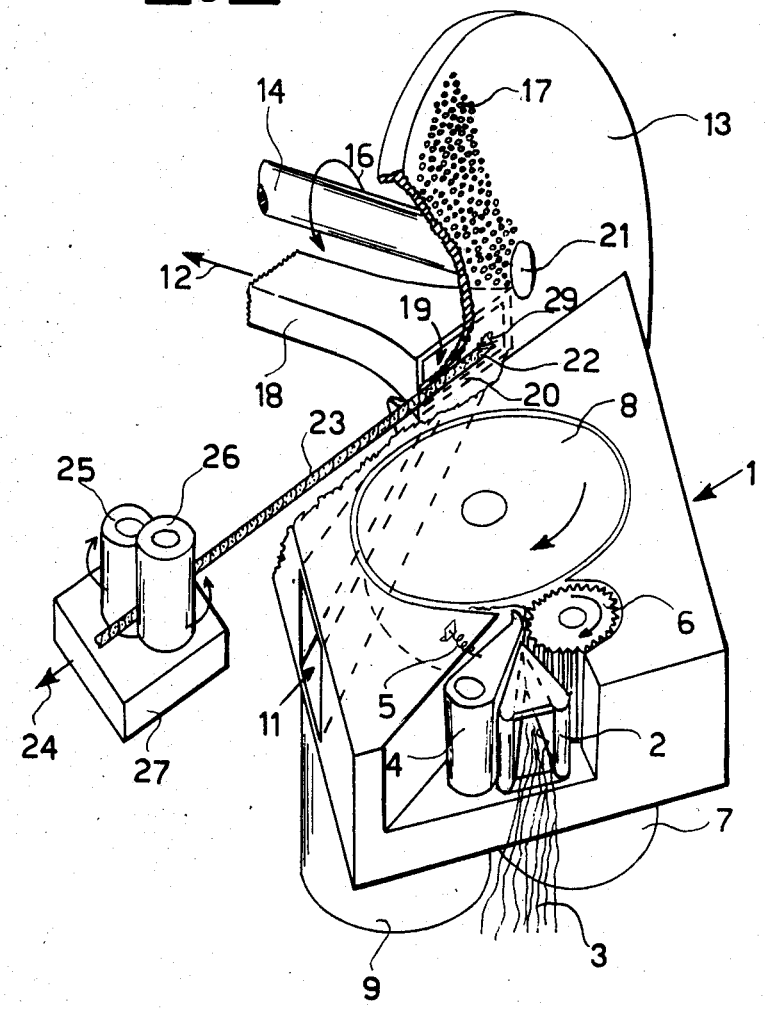
FIG. 1 is a partial perspective view of a device for friction open-end spinning according to the invention.

Referring to the figures, the feed unit is indicated generally at 1 and is well known in the open-end spinning art. This feed unit comprises a condenser 2, for condensing or compacting the fiber sliver 3 being fed to the device, causing it to assume a flat shape of rectangular cross section suitable to be pinched between pressure plate 4. This pressure plate 4 is acted on by spring 5 and feeding roller 6. The feed roller 6 is driven by electric motor 7.

Plate 4 applies a predetermined pressure strength to sliver 3. This pressure and the friction existing between sliver 3 and roller 6, performs a driving action on sliver 3 and thus feeds it to the fiber separation unit 8. This unit 8 is provided with teeth and pins and is driven by electric motor 9 to separate sliver 3.

Figure 2:
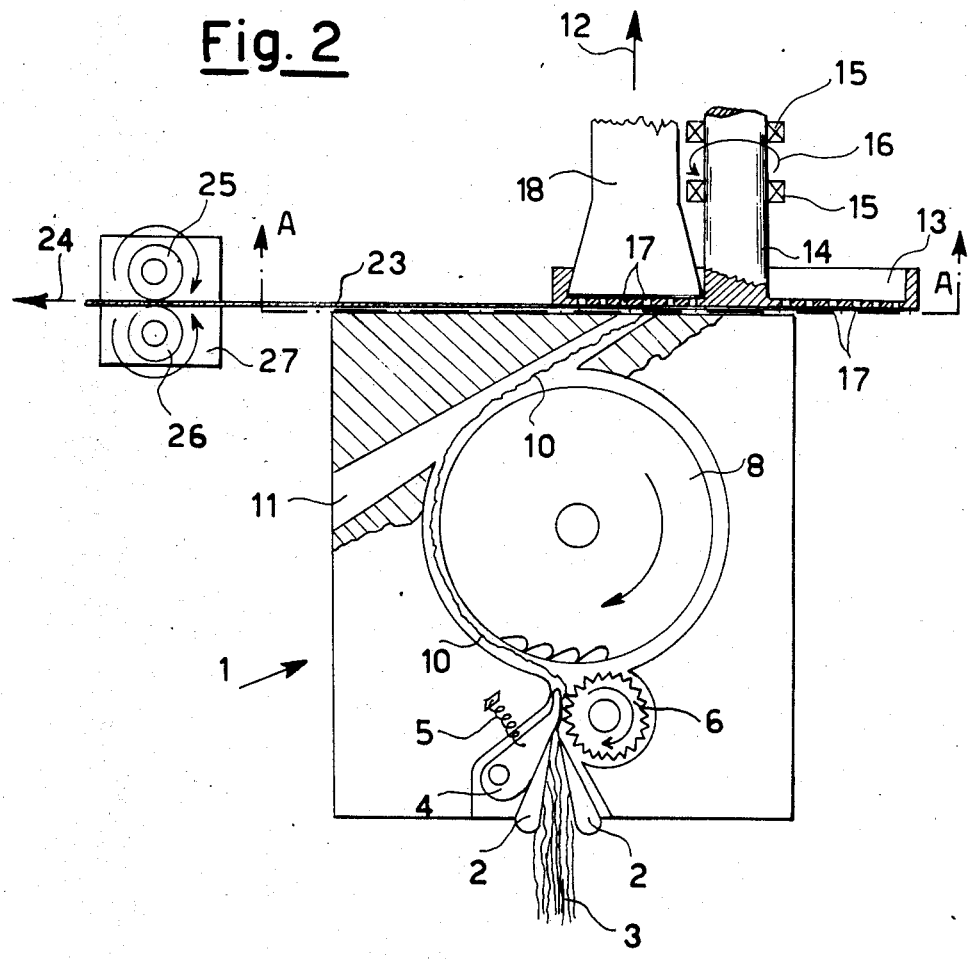
FIG. 2 is a plan sectional view of the device of FIG. 1.

The discrete fibers 10 are conveyed onto the twister element 13 by means of a stream of intaken air induced in the adduction channel 11 by a suction 12 created by a vacuum source (not shown). The twister element 13 comprises a flat disc, the shaft 14 of which is rotatably supported by bearings 15 (see FIG. 2). Twister 13 revolves according to the direction of the arrow 16 (counterclockwise in figure) by revolving means (not shown).

Figure 3:
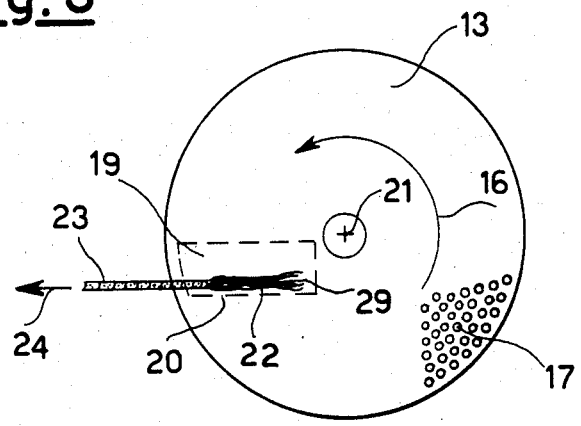
FIG. 3 is a partial front view taken along line A—A of FIG. 2, showing the twister element of the device of FIG. 1.

The disc twister 13 is provided with perforations 17 arranged along an annulus. The rear portion of perforations 17 cooperate with duct 18. This duct 18 is provided with a rectangular suction slot 19, the rear edge of which constitutes the yarn formation line 20. Suction slot 19 is positioned along a chord of disc 13 (see specifically FIG. 4), and extends from the disc rim up to near the center 21 of the disc (see FIG. 3).

The discrete fibers 10 are conveyed onto disc 13 parallel to slot 19 and substantially parallel to the end 22 of the yarn being formed 23. Once on the disc, fibers 10 get condensed under the effect of suction 12 through slot 19. Also, suction 12 keeps fibers 10 adhering against the disc where they are dragged until they arrive near rear edge 20 of suction slot 19. At that point they are not being influenced by suction 12 and roll up on themselves and gain twist.

The yarn 23 which is formed is then extracted along the direction of suction slot 19 and according to the direction of arrow 24, by draw rollers 25 and 26, rotatably mounted on a support 26. At least one of the two rollers is driven by a motor (not shown), and is wound and collected on a package (not shown).

Figure 4:
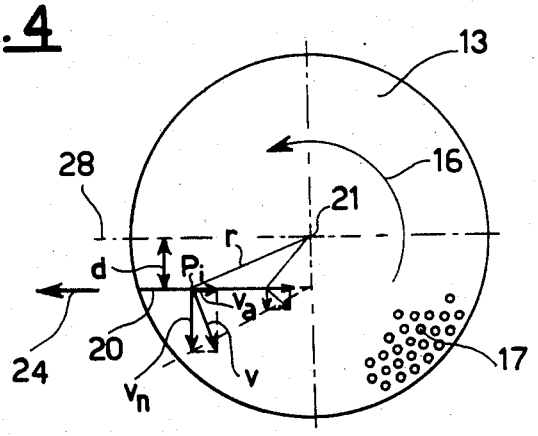
FIG. 4 is the vectorial representation of the speeds along the yarn formation line of the device of FIG. 1.

As can be clearly seen at FIG. 4, due to the particular position of the yarn formation line 20 along a chord of the disc twister 13, the dragging speed v of the fibers at individual points, for example $P_i$, of the yarn formation line 20 varies with the distance r of the point in question from the revolution center 21 of disc 13 according to the law:

$$v = w \cdot r$$

wherein w is the angular velocity of the disc. Hence, velocity increases linearly from the center towards the edge of the disc. On the other hand, each dragging speed can be resolved, relative to yarn, into a component axial to the yarn $v_a$, and a component perpendicular to the yarn $v_n$. The axial component $v_a$ of the dragging speeds has a value in each point of line 20 which is constant, and equal to wxd, where d is the distance of the yarn formation line 20 from the axis 28 of the disc of twister 13 which is parallel to line 20.

As correspondence of the lower half of the counterclockwise revolving disc (arrow 16), axial component $v_a$ is directed opposite the yarn draw direction 24 and is hence able to tension the fibers during their twisting.

The perpendicular components $v_n$ of the dragging speeds, which cause fiber twisting, are variable with the dragging speeds. Thus $v_n$ reaches its minimum value at the open end 29 (see FIG. 3) of the end of the yarn being formed 23. This is desirable because at that point, few fibers are present, and the yarn firmness is poor.

FIGS. 5 and 6 illustrate variants of twisting elements characterized by a protruding-point hollow conical disc 30 or by a reentering-point hollow conical disc 31, provided with perforations 17. FIGS. 7 through 9 illustrate a further variant of the twisting element, characterized by a small cylinder 32 mounted on outer bearings 33 and provided with perforations 17 in its base surface 34. This base surface 34 can be either flat (FIG. 7), concave (FIG. 8) or convex (FIG. 9).

Figure 10:
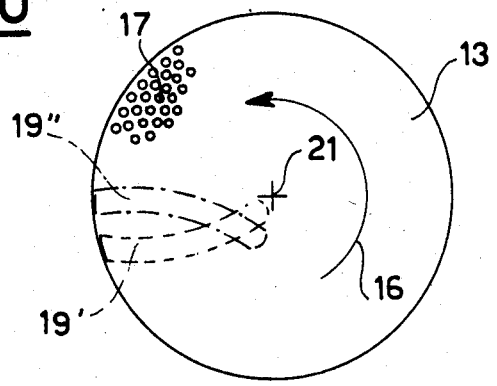
FIG. 10 is a schematic view of variants in the shape of the suction slot according to the invention.

Finally, FIG. 10 shows suction slots 19' or 19'' (in phantom) which, instead of being rectangular, are of a curved shape.

We claim:

1. A spinning process of the friction open end type for adding fibers of a feed silver to a yarn end to form yarn, comprising the steps of:

separating the fibers of the feed silver; feeding the separated fibers substantially parallel with the yarn end to a revolving twisting element;

adhering said separated fibers and yarn end to said revolving twisting element by means of suction; and twisting under adjustable tension said separated fibers and yarn end by means of suction and rotation to form yarn, said twisting progressively increasing from the end of the yarn onwards.

2. A spinning device of the friction open-end type for adding fibers of a feed silver to the yarn end to form yarn comprising:

a fiber separation unit;

a suction duct;

a suction slot extending between said fiber separation unit and said suction duct;

a revolving perforated twister element interposed between said suction slot and said suction duct such that the air is drawn through such slot and the perforations aligned with said duct to maintain and twist said fibers and yarn end into yarn; and drawing means for adjustably tensioning and extracting the yarn substantially along the direction of said suction slot.

3. A device according to claim 2, wherein said suction slot is adjustable relative to the axis of the twister element.

4. A device according to claim 2, wherein said revolving twister element is a hollow conical disc.

5. A device according to claim 2, wherein said revolving twister element is a cylinder mounted on outer supporting bearings, said cylinder having a perforated surface provided in its flat basis.

6. A device according to claim 5 wherein the basis of the cylinder containing the perforated surface is concave.

7. A device according to claim 5, wherein the basis of the cylinder in which the perforated surface located is concave.

8. A device according to claim 2, wherein the suction slot has a curved shape.

9. Device according to claims 2, 4 or 5, characterized in that the perforated surface of the twister element is provided with differentiated perforation pattern along the yarn formation line.

10. Device according to claims 2, 4 or 5, characterized in that the perforated surface of the twister element has a roughness variable.

* * * * *